US006363637B1

(12) United States Patent
Birmingham

(10) Patent No.: US 6,363,637 B1
(45) Date of Patent: Apr. 2, 2002

(54) SPINNING MOBILE

(76) Inventor: Joan Birmingham, P.O. Box 3577, San Bernardino, CA (US) 92413

( * ) Notice: Subject to any disclaimer, the term of this patent is extended or adjusted under 35 U.S.C. 154(b) by 0 days.

(21) Appl. No.: 09/560,861

(22) Filed: Apr. 28, 2000

(51) Int. Cl.[7] ..... G09F 19/00
(52) U.S. Cl. ..... 40/440; 412/439
(58) Field of Search ..... 40/412, 439, 440

(56) References Cited

U.S. PATENT DOCUMENTS 2,688,820 A * 9/1954 Shemet ..... 40/440
2,923,088 A * 2/1960 Peretti ..... 40/440
5,659,988 A * 8/1997 Kim et al. ..... 40/440
5,664,351 A * 9/1997 Jonas ..... 40/415
6,178,673 B1 * 1/2001 Blackford et al. ..... 40/440

* cited by examiner

*Primary Examiner*—Christopher P. Schwartz
(74) *Attorney, Agent, or Firm*—Fulwider Patton Lee & Utecht, LLP

(57) ABSTRACT

A spinning mobile includes a central shaft having first and second ends, a top mounting cap located at the first end of the shaft and a bottom mounting cap located at the second end of the shaft. A plurality of design plates are mounted to the top mounting cap and bottom mounting cap to cooperatively form a particular structural design capable of spinning when suspended in the air and subjected to air currents.

16 Claims, 4 Drawing Sheets

SPINNING MOBILE

BACKGROUND OF THE INVENTION

The present invention relates generally to decorative mobiles which can be placed, for example, in a yard to provide a fanciful ornamental display and, more particularly, to an easily assembled spinning mobile that can be suspended in air and set in a spinning motion by air currents. The spinning mobile of the present invention can be constructed in a number of eye-catching shapes and designs.

A variety of decorative yard ornaments have been developed throughout the years for use in open areas such as back or front yards, patios, balconies, and the like. These devices include, for example, wind chimes which have a number of sound producing elements, sometimes shaped as ornaments, that are suspended on strings and produce distinct musical notes or chimes when the elements strike one another while being tossed about by a gust of wind. Other devices include weathervanes which can come in a number of decorative designs to complement a particular setting. Still other ornamental devices include colorful windsocks which catch the wind and deploy to display a colorful arrangement that create quite an eye-catching effect. Old standards, such as pinwheels, also can adorn a garden or yard area to provide a whirling visual effect when a sudden gust of wind sets the pinwheel in motion. Spinning kites having turbine-like, curved vanes also create a colorful spinning effect when rotated by the wind. The visual effects created by these devices are certainly eye-catching and can provide a very colorful, decorative ornament for adorning a particular setting.

Consumers are constantly in search of new and colorful gadgets which can be placed in an open area, or even indoors, for decorative purposes or to simply provide a unique visual effect to an observer. Therefore, there is always a need for new ornamental devices that can be hung from a tree, patio cover, or the like to provide a eye-catching arrangement that enhances the beauty of a setting or provides an ornament for a particular holiday or time of the season. Such a device should be relatively easy to assemble and disassemble, as needed, and would be particularly useful if it could be disassembled for storage in a relatively low profile box. The present invention satisfies these and other needs.

SUMMARY OF THE INVENTION

The present invention is directed to an easily assembled spinning mobile which can be suspended in air and sent in rotational motion by air currents. The present invention can be constructed in a number of eye-catching shapes and sizes and can be easily disassembled for convenient storage in a low profile box.

The present invention includes a number of design plates which are formed in a particular shape and are mounted to a central core assembly to cooperatively form a desired structural design. The central core assembly includes a central shaft having first and second ends, a top mounting cap attached to the first end of the shaft and a bottom mounting cap located at the second end of the shaft. The top and bottom mounting caps are designed to hold the individual design plates on the assembly to achieve the desired composite shape of the device.

In one embodiment, the top and bottom mounting caps each include a recessed portion adapted to receive tab-like projections formed on each design plate. In this manner, each design plate has two tab-like projections which fit within the recessed portions of the top and bottom mounting caps to hold the design plate to the assembly. A spacing member can be included to hold each design plate at a particular location along the central shaft. In this manner, each plate can be appropriately spaced along the 360 degree radius of the shaft to form the desired structural shape of the mobile. The number of design plates which can be mounted to the central core assembly can be as little as two to as many as can be reasonably mounted to the core assembly. Additionally, the size and shape of each design plate can be the same or could vary depending upon the desired composite structure to be created. Each design plate can include colorful designs, patterns, and the like, to achieve a colorful spinning ornament that can accent any setting and achieve an eye-catching visual effect.

These and other advantages of the present invention become more apparent from the following detailed description of the invention, when taken in conjunction with the accompanying exemplary drawings.

DETAILED DESCRIPTION OF THE PREFERRED EMBODIMENTS

Figure 1:
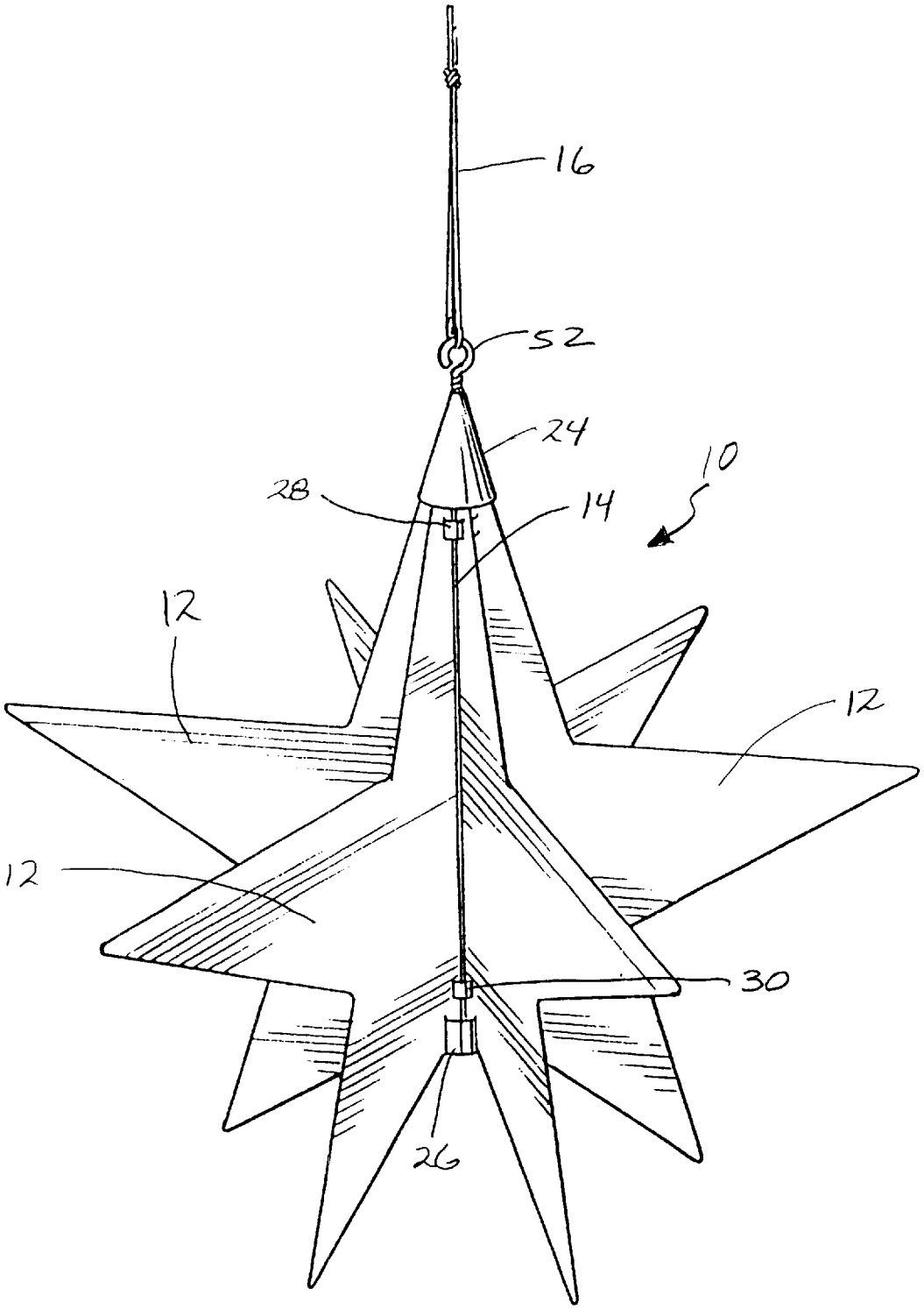
FIG. 1 is a perspective view of one particular embodiment of a spinning mobile made in accordance with the present invention.
Figure 2:
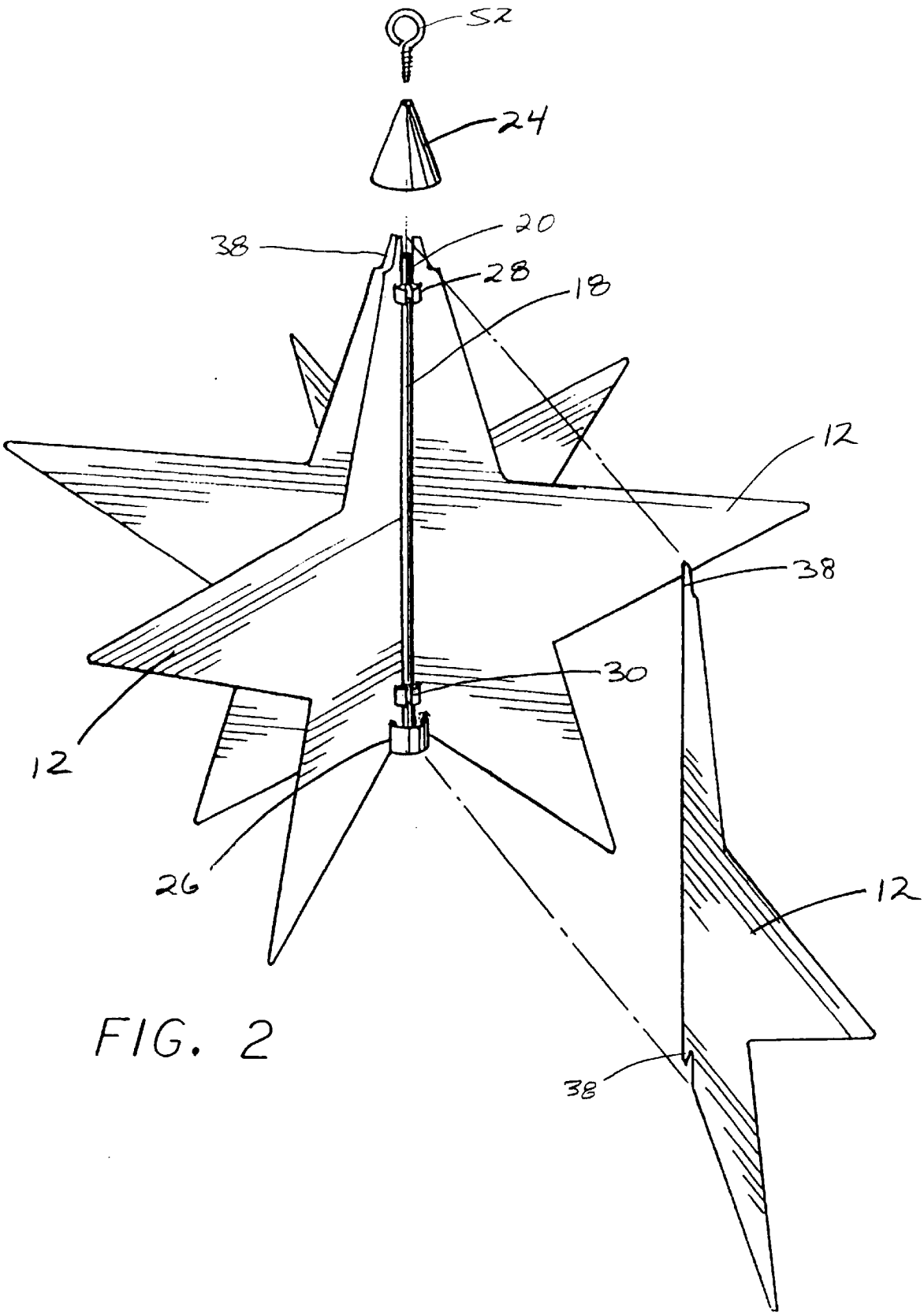
FIG. 2 is a perspective view of the embodiment of FIG. 1, with one design plate removed from the assembly to show one way of mounting each design plate to the central core assembly of the device.
Figure 5:
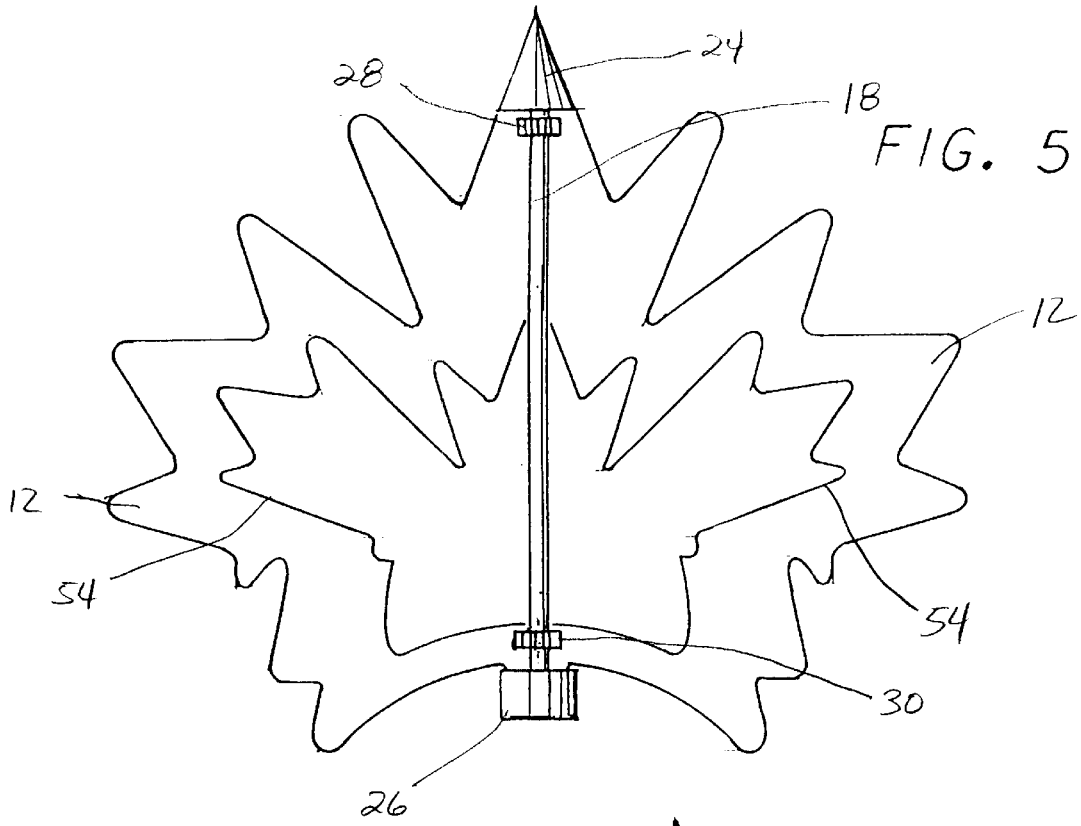
FIG. 5 is a side elevational view of another embodiment of a spinning mobile made in accordance with the present invention showing the design plates formed as a maple leaf, exemplifying yet another one of the many configurations which could be created utilizing the present invention.

Turning to the drawings, in which like reference numbers represent like or corresponding elements in the drawings, FIGS. 1 and 2 illustrate an embodiment of a spinning mobile 10 incorporating features of the present invention. In the particular embodiment shown in FIGS. 1 and 2, the spinning mobile 10 includes a number of design plates 12 which are attached to a central core assembly 14 (shown in greater detail in FIG. 3) to form a composite ornamental design. In the embodiment shown in FIGS. 1 and 2, the design plates 12 form a spinning star which, when suspended from a string 16, rotates when a gust of wind blows against the surface of the plates 12. It should be appreciated that in this particular example, there are six design plates 12 which form the star design as shown. However, the number of design plates which can be utilized with this or any embodiment of the present invention can vary from as little as two to as many as can be reasonably placed on the central core assembly 14. The number of design plates utilized does not diminish from the spirit and scope of the present invention. Additionally, the particular shape of each design plate 12 can be manufactured in a number of different structures, two of which are shown in FIGS. 4 and 5. However, any number of different shapes can be used to form the design plates to create the desired, composite ornamental structure.

Figure 3:
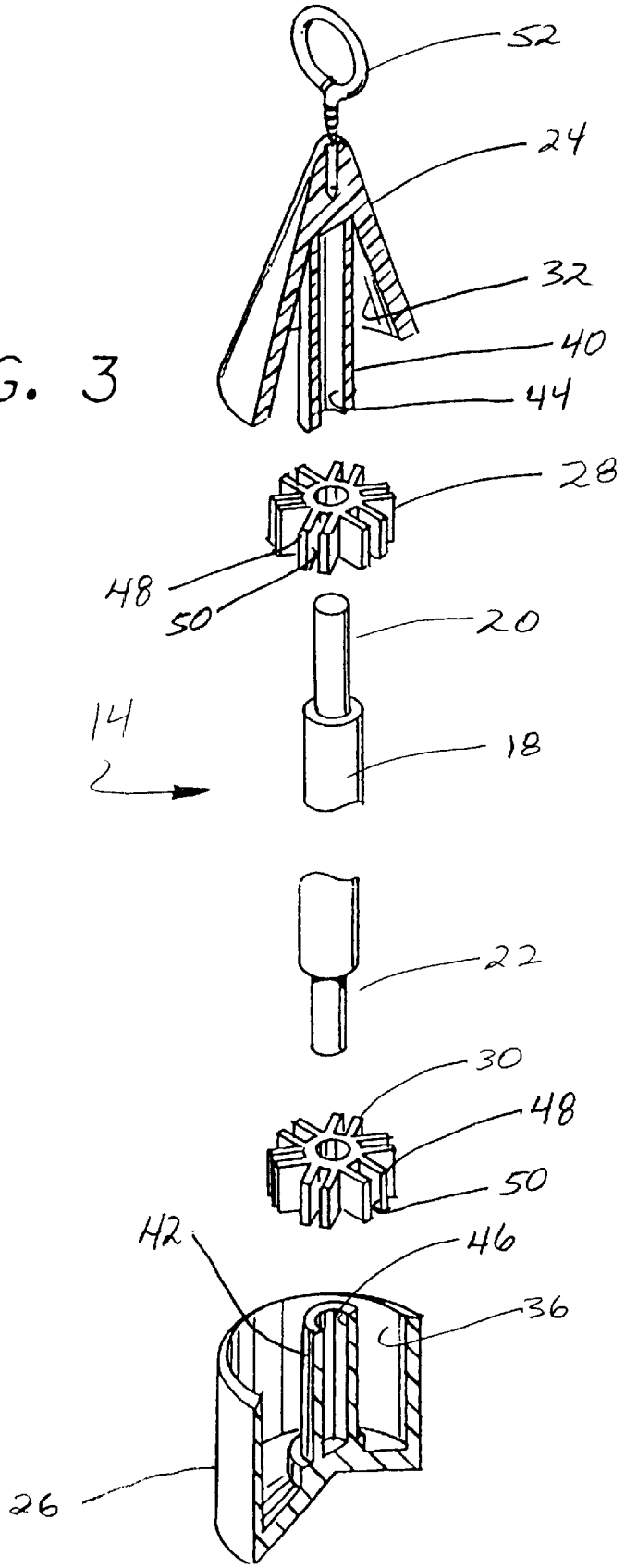
FIG. 3 is a perspective view, partially shown in cross-section, of an embodiment of the center core assembly which forms a mechanism for holding each individual design plate in position to form the composite spinning mobile made in accordance with the present invention.
Figure 4:
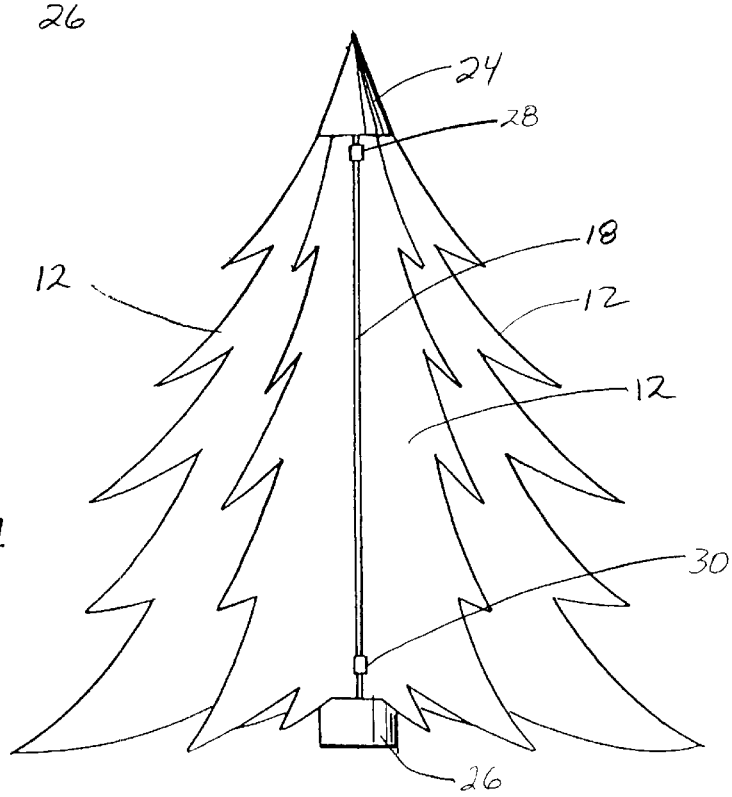
FIG. 4 is a side elevational view of another embodiment of a spinning mobile made in accordance with the present invention showing the design plates formed as an ornamental Christmas tree.

Referring additionally now to FIG. 3, which shows the central core assembly 14 in greater detail, the spinning mobile 10 is a composite device made up from a number of design plates 12 that are mounted to the central core assembly 14. The central core assembly 14 includes a central shaft 18 having a first end 20 and a second end 22. A top mounting cap 24 is located at the first end 20 of the central shaft 18 and a bottom mounting cap 26 is likewise placed at the second end 22 of the central shaft 18. The top and bottom mounting caps 24 and 26 are utilized to secure each design plate 12 to the central core assembly 14. A pair of spacing members 28 and 30 are located along the central shaft 18 to provide additional means for maintaining each design plate 12 at a fixed location along the central shaft 18. In this manner, each spacing member includes a structure to hold at least a portion of the design plate 12 and prevent the design plate 12 from rotating or moving relative to the central core assembly 14.

As can be seen better in FIG. 3, the top mounting cap 24 includes a recessed portion 32 which is adapted to receive a tab-like projection 38 located and formed on each of the design plates 12. Likewise, the bottom mounting cap 26 includes a recessed portion 36 which also receives tab-like projections 38 formed on each design plate 12. The top mounting cap 24 further includes an elongated tubular shaft 40 adapted to receive the first end 20 of the central shaft 18. Likewise, the bottom mounting cap 26 includes an elongated tubular shaft 42 adapted to receive the second end 22 of the central shaft 18. As can be seen in FIG. 3, each of the first and second ends 20 and 22 of the central shaft 18 have a smaller diameter than the main portion of the shaft 18 to allow a tight fit within the cylindrical openings 44 and 46 formed on each of the elongated tubular shafts of the top and bottom mounting caps 24 and 26. The spacing member 30 can be placed on the first end 20 of the shaft 18 before the end 20 is placed within the cylindrical opening 44. Likewise, the spacing member 30 can be placed on the second end 22 prior to the shaft being mounted to the bottom mounting cap 26. Frictional contact between the spacing member and the shaft prevents the spacing member from rotating on the shaft.

Each design plate 12 has a particular thickness adapted to fit within one of the pair of ribs 48 formed on each spacing member. The design plate 12 fits within the opening 50 formed between each pair of ribs 48 to prevent the plate 12 from rotating on the shaft 18 during usage. The location and number of ribs 48 on each spacing member sets the particular alignment of design plates on the central core assembly 14. Although the spacing members 28 and 30 are shown as separate pieces, they could be formed within the recessed portions of the top and bottom mounting caps, if desired. The design plates 12 should snugly fit within each opening 50 to assist in holding and aligning each design plate 12 to the central core assembly 14.

The design plates 12 can be made from a number of different materials such as, but not limited to, mylars, polymeric materials, plastics, cardboard, lightweight metals and the like. Manufacturing concerns may dictate what particular materials should be utilized to provide a cost-effective novelty item for consumers. The central core assembly 14 can be made from plastic components or alternatively lightweight metal components that provide the functional features identified above. The plastic could be clear, see-through plastic or a colored plastic, depending on the design consideration. It should be appreciated that the top and bottom mounting caps also can be manufactured in any one of a number of particular shapes, not just that shown, without departing from the spirit and scope of the invention. Additionally, the mounting caps can be either removable or permanently attached to the shaft using, for example, an adhesive. However, the use of removable mounting caps allows the user to disassemble the unit, if desired, and allows the user to mount different shaped design plates to the central core assembly to create other unique designs. Additionally, an end ring 52 could be placed or formed on the top mounting cap 24 to provide a convenient fastening point to attach a string 16 or wire to allow the spinning mobile 10 to be hung at the desired location.

Each design plate 12 can be shaped in the same configuration or can be a completely different configurations which cooperatively create the desired composite structure. Additionally, each side of the design plate 12 can be printed with additional designs, patterns, emblems, and the like, to provide an even more eye-catching design. In fact, when printed with additional colors and designs, the spinning effect created by the present invention could create a somewhat hypnotic effect on the viewer. The manner in which the color printing is placed on the surfaces of the design plates 12 include a number of printing techniques which are well-known in the art.

The shape of each design plate can be varied to create additional and unique composite ornaments. For example, FIGS. 4 and 5 show just two of the many other embodiments which can be created utilizing specially shaped design plates. For example, in FIG. 4, each design plate 12 is formed in a shape of tree branches to create a Christmas tree ornament which can be hung either outside or indoors. FIG. 5 shows yet another design, here the form of a maple leaf, which can be utilized in accordance with the present invention. In this particular embodiment, each design plate 12 is cut in the form of a maple leaf. Line 54 shows an additional maple leaf which can be drawn or printed on the surface of the plate 12 to create a desired effect to the viewer. Additionally, the inner maple leaf design designated by line 54 could actually be cut out of the design plate 12 to create an even different effect when the spinning mobile 10 turns in a strong wind. The smaller maple leaf designated by line 54 could also be formed as a design plate which is smaller than the plate 12 that forms the maple leaf. Additional spacing members could be placed along the length of the shaft 18 to mount and hold the smaller plates to the central core assembly. Again, these alternative embodiments show other ways in which the design plate can be manufactured to create an aesthetically pleasing ornamental effect.

In view of the foregoing, it is apparent that a spinning mobile of the present invention provides a unique novelty item which can be easily assembled and disassembled by the user and can create a colorful ornamental and visual display to an observer. Further modifications and improvements may additionally be made to the spinning mobile as disclosed herein without departing from the scope of the present invention. Accordingly, it is not intended that the invention be limited, except as by the appended claims.

What is claimed is:

1. A spinning mobile, comprising:

a central shaft having a first end and a second end;

a top mounting cap located at the first end of the central shaft;

a bottom mounting cap located at the second end of the central shaft; and a plurality of design plates mounted to the top mounting cap and bottom mounting cap to cooperatively form a particular structural design, wherein each of the top mounting and bottom mounting caps have a recessed portion and each design plate includes tab-like projections which are housed within the recessed portion of the top and bottom mounting caps.

2. The spinning mobile of claim 1, further including a spacing member adapted to hold the design plates in a particular arrangement along the central shaft.

3. The spinning mobile of claim 1, wherein the top and bottom mounting caps are removably attached to the central shaft.

4. A decorative hanging mobile which can be suspended in air and is rotatable by air currents, comprising:

a plurality of design plates which cooperatively form a particular structural design; and a central core assembly including a central shaft having a first end and a second end, a top mounting cap located at the first end of the central shaft, a bottom mounting cap located at the second end of the central shaft, wherein the plurality of design plates are mounted between the top mounting cap and bottom mounting cap, wherein each of the top mounting and bottom mounting caps has a recessed portion and each design plate includes tab-like projections which are housed within the recessed portion of the top and bottom mounting caps.

5. The decorative hanging mobile of claim 4, wherein the design plates have different sizes and shapes.

6. The decorative hanging mobile of claim 5, further including spacing members mounted along the length of the central shaft to hold design plates to the central core assembly.

7. The decorative hanging mobile of claim 4, wherein the design plates are made from a mylar material.

8. The decorative hanging mobile of claim 7, wherein the central core assembly is made from plastic.

9. The decorative hanging mobile of claim 4, wherein each of the design plates has the same size and shape.

10. The decorative hanging mobile of claim 4, wherein the top and bottom mounting caps are removably attached to the central shaft.

11. The decorative hanging mobile of claim 4, wherein the design plates are made from a substantial flat material.

12. The decorative hanging mobile of claim 4, further including a ring-like member for receiving a length of string for hanging purposes.

13. The decorative hanging mobile of claim 4, further including a spacing member adapted to hold the design plates in a particular arrangement along the central shaft.

14. The decorative hanging mobile of claim 4, wherein both of the top and bottom mounting caps include a tubular member with an opening for receiving the first and second ends of the central shaft.

15. The decorative hanging mobile of claim 4, wherein the design plates spin along the axis form by the central shaft when subjected to air currents.

16. A decorative hanging mobile which can be suspended in air and is rotatable by air currents, comprising:

a plurality of design plates which cooperatively form a particular structural design;

a spacing member adapted to hold the design plates in a particular arrangement along the central shaft;

a central core assembly including a central shaft having a first end and a second end, a top mounting cap located at the first end of the central shaft, a bottom mounting cap located at the second end of the central shaft, wherein the plurality of design plates are mounted between the top mounting cap and bottom mounting cap; and a spacing member adapted to hold the design plates in a particular arrangement along the central shaft, the spacing member including a plurality of pairs of rib-like projections which form an opening adapted to hold the design plates in a particular arrangement along the central shaft.

* * * * *